US012637834B2

(12) United States Patent
Johnson et al.

(10) Patent No.: US 12,637,834 B2
(45) Date of Patent: May 26, 2026

(54) COMPACT UTILITY MACHINE WITH A PASSIVE COOLING SYSTEM

(71) Applicant: Wacker Neuson America Corporation, Menomonee Falls, WI (US)

(72) Inventors: Tyler Johnson, Wauwatosa, WI (US); Donovan Knutson, Slinger, WI (US)

(73) Assignee: Wacker Neuson America Corporation, Menomonee Falls, WI (US)

( * ) Notice: Subject to any disclaimer, the term of this patent is extended or adjusted under 35 U.S.C. 154(b) by 687 days.

(21) Appl. No.: 18/099,023

(22) Filed: Jan. 19, 2023

(65) Prior Publication Data

US 2024/0247465 A1 Jul. 25, 2024

(51) Int. Cl.

| | |
|---|---|
| ***E02F 9/08*** | (2006.01) |
| ***E02F 3/34*** | (2006.01) |
| ***E02F 9/16*** | (2006.01) |
| ***E02F 9/22*** | (2006.01) |

(52) U.S. Cl.

CPC ..... *E02F 9/0866* (2013.01); *E02F 3/3414* (2013.01); *E02F 9/16* (2013.01); *E02F 9/22* (2013.01)

(58) Field of Classification Search

CPC ..... E02F 9/0866; E02F 3/3414; E02F 9/16; E02F 9/22; F01P 2005/025; F01P 5/06; F01P 2060/04; F01P 1/02; F01P 1/06; F01P 2001/005; F01P 5/02

See application file for complete search history.

(56) References Cited

U.S. PATENT DOCUMENTS 4,117,902 A * 10/1978 Henline ..... B60K 11/04 180/54.1

FOREIGN PATENT DOCUMENTS

| | | | | |
|---|---|---|---|---|
| CA | 1250501 A | | 2/1989 | |
| CN | 111594312 A | * | 8/2020 | ..... F01M 5/002 |
| DE | 2934095 A1 | | 3/1981 | |
| DE | 19701082 A1 | * | 7/1998 | ..... F02B 63/02 |
| EP | 1916757 A2 | | 4/2008 | |
| EP | 2500542 B1 | | 5/2013 | |
| EP | 2871290 B1 | | 1/2019 | |

(Continued)

OTHER PUBLICATIONS

JP-6591356-B2 English Translation (Year: 2019).*

(Continued)

*Primary Examiner* — Michael T. Walsh
(74) *Attorney, Agent, or Firm* — Boyle Fredrickson, S.C.

(57) ABSTRACT

A compact utility machine, such as a compact track loader or wheel loader, a compact telehandler, or a compact trencher, implements a passive cooling system. The passive cooling system may establish a negative pressure zone within the machine's engine compartment to draw ambient air into the engine compartment for cooling various components. The negative pressure zone may be defined upstream with respect to an exhaust fan that pushes air out of the engine compartment. A pressure differential is defined between the ambient air and the negative pressure zone, which drives air into the engine compartment through an air inlet(s) in an engine compartment side wall(s). A hydraulic oil cooler may be mounted inside of the engine compartment, overlying one of the engine compartment's air intakes.

20 Claims, 5 Drawing Sheets

(56) References Cited

FOREIGN PATENT DOCUMENTS

| | | | | | |
|---|---|---|---|---|---|
| GB | 731326 | A | | 6/1955 | |
| JP | 2008075558 | A | * | 4/2008 | |
| JP | 2010190175 | A | * | 9/2010 | |
| JP | 4996349 | B2 | * | 8/2012 | ..... F01P 5/06 |
| JP | 6591356 | B2 | * | 10/2019 | |
| KR | 20090104493 | A | | 10/2009 | |
| WO | WO-2013034019 | A1 | * | 3/2013 | ..... F02B 63/042 |
| WO | WO-2021021943 | A1 | * | 2/2021 | ..... E02F 9/2267 |

OTHER PUBLICATIONS

WO-2021021943-A1 English Translation (Year: 2021).*
JP-2008075558-A English Translation (Year: 2008).*
CN-111594312-A English Translation (Year: 2020).*
WO-2013034019-A1 English Translation (Year: 2013).*
DE-19701082-A1 English Translation (Year: 1998).*
JP-2010190175-A English Translation (Year: 2010).*
European Search Report (Aug. 11, 2024) (Year: 2024).*
JP-4996349-B2 English Translation (Year: 2012).*

* cited by examiner

COMPACT UTILITY MACHINE WITH A PASSIVE COOLING SYSTEM

BACKGROUND OF THE INVENTION

1. Field of the Invention

The present invention relates to a compact utility machine with a passive cooling system. More particularly, the invention relates to a compact utility machine with a passive cooling system that establishes a negative pressure zone within an engine compartment to draw air across components for cooling. The invention additionally relates to a method of operating such a machine.

2. Discussion of the Related Art

Utility machines such as skid steer loaders, track loaders, and utility track loaders typically have liquid cooled engines. Many cooling systems of these machines include joint engine coolant radiators and hydraulic oil coolers that are mounted remotely from their engines. Active cooling systems have fans that are mounted against and push cooling air across the joint radiators/coolers and into the engine compartment. These fans are typically remote from the engine and are rotated by either electric motors or hydraulic motors. The components and controls needed for implementing electric and hydraulic fans add to overall system cost, complexity, and can create maintenance challenges.

Some utility machines are designed to be relatively smaller to accommodate certain operating environments in which light operational weight and enhanced maneuverability are desirable. Such "compact machines" or "compact utility machines" include telehandlers, skid-steer machines, trenchers, and loaders. Loaders of this type are referred to as "compact utility loaders", "compact loaders", "mini loaders," or "compact mini loaders." The term "compact utility machines" will be used herein for the sake of consistency. Compact utility machines may be propelled by either wheels or tracks. Depending on their design and size, compact utility machines may be controlled by a seated operator or a standing operator stationed on a platform at the rear of the machine.

Some compact utility machines employ smaller and lighter air-cooled engines instead of liquid-cooled engines in order to reduce the weight and size of these smaller machines. However, compact utility machines still need to cool their hydraulic systems' oil. This is done with oil cooling systems that have oil coolers and cooperating electric or hydraulically driven fans as active cooling systems that push cooling air into the engine compartments and across the oil coolers, similar to cooling systems of larger machines with liquid-cooled engines. Due to limited space in compact utility machines, some of the oil cooling systems require baffling to direct the air from the fans across the oil coolers, which again adds to overall system cost, complexity, and can create maintenance challenges.

Other compact utility machines that implement air-cooled engines mount their engines and/or oil coolers toward the back of their engine compartments. Often these implementations are mostly open, with the engines and/or oil coolers widely exposed to enhance cooling by allowing heat to be freely shed from the air-cooled engine and/or oil cooler into the ambient air. However, this can increase the temperature at operator stations, particularly with respect to stand-on operator platforms, which decreases operator comfort.

Thus, it would be desirable to provide a utility loader or other compact utility machine that has an air-cooled engine and a cooling system without an ancillary fan to directly push cooling air through a hydraulic oil cooler and into an engine compartment.

It would also be desirable to provide a compact utility machine that can passively shed heat from heat-generating components, without compromising operator comfort.

SUMMARY OF THE INVENTION

In accordance with a first aspect of the invention, at least some of the above-discussed challenges are addressed by a compact utility machine, such as a compact loader, a compact telehandler, a compact skid-steer machine, or a compact trencher, that implements a passive cooling system for cooling hydraulic oil.

In accordance with another aspect of the invention, the passive cooling system includes an exhaust fan that evacuates air from the machine's engine compartment. This establishes a negative pressure zone within the engine compartment that draws cooling air from the ambient into the engine compartment, upstream of the exhaust fan. A positive pressure zone is defined downstream of the exhaust fan, through which an airflow from the engine compartment is released into the ambient.

In accordance with another aspect of the invention, the exhaust fan rotates within a fan shroud that defines a boundary between the negative and positive pressure zones.

In accordance with another aspect of the invention, the compact utility machine implements an air-cooled engine. The air-cooled engine has an engine-cooling fan mounted within the engine's blower housing. The engine-cooling fan and the exhaust fan may be mounted to opposite ends of the engine's crankshaft.

In accordance with another aspect of the invention, a pump stack defined by a pair of hydraulic pumps is driven by the end of the engine crankshaft that drives the engine-cooling fan in the blower housing. A coupler may connect the hydraulic pump(s) to the crankshaft and longitudinally space the pump(s) from the blower housing, providing an uncovered inlet through which the blower housing can receive air.

In accordance with another aspect of the invention, an oil cooler is mounted in the engine compartment's negative pressure zone, against an air inlet. Ambient air is drawn into the negative pressure zone passively and flows across the oil cooler as a function of the pressure differential between the ambient and the engine compartment's negative pressure zone.

In accordance with another aspect of the invention, the pump stack extends axially from and is connected to an engine output shaft at the engine's flywheel side. This may position the pump stack relatively low in the engine compartment and contribute to a low center of gravity when compared to belt-driven or other high-mounted pump arrangements.

In accordance with another aspect of the invention, the pump stack is mounted upstream of the engine and the fan(s) that drives air out of the engine compartment. This may position the pump stack in an operational envelope that is outside of a heat-influenced zone of the engine, passively reducing the pump stack's operating temperature.

In accordance with another aspect of the invention, the pump stack is mounted toward a back end of the loader, near an operator platform. This rear-mounted configuration of the pump stack allows for use of shorter hydraulic hoses from the pumps to hydraulically driven components, such as hydraulic cylinders that actuate the loader boom's lift arms.

In accordance with another aspect of the invention, a method is provided of operating a compact utility machine having at least some of the features described above.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION

Figure 1:
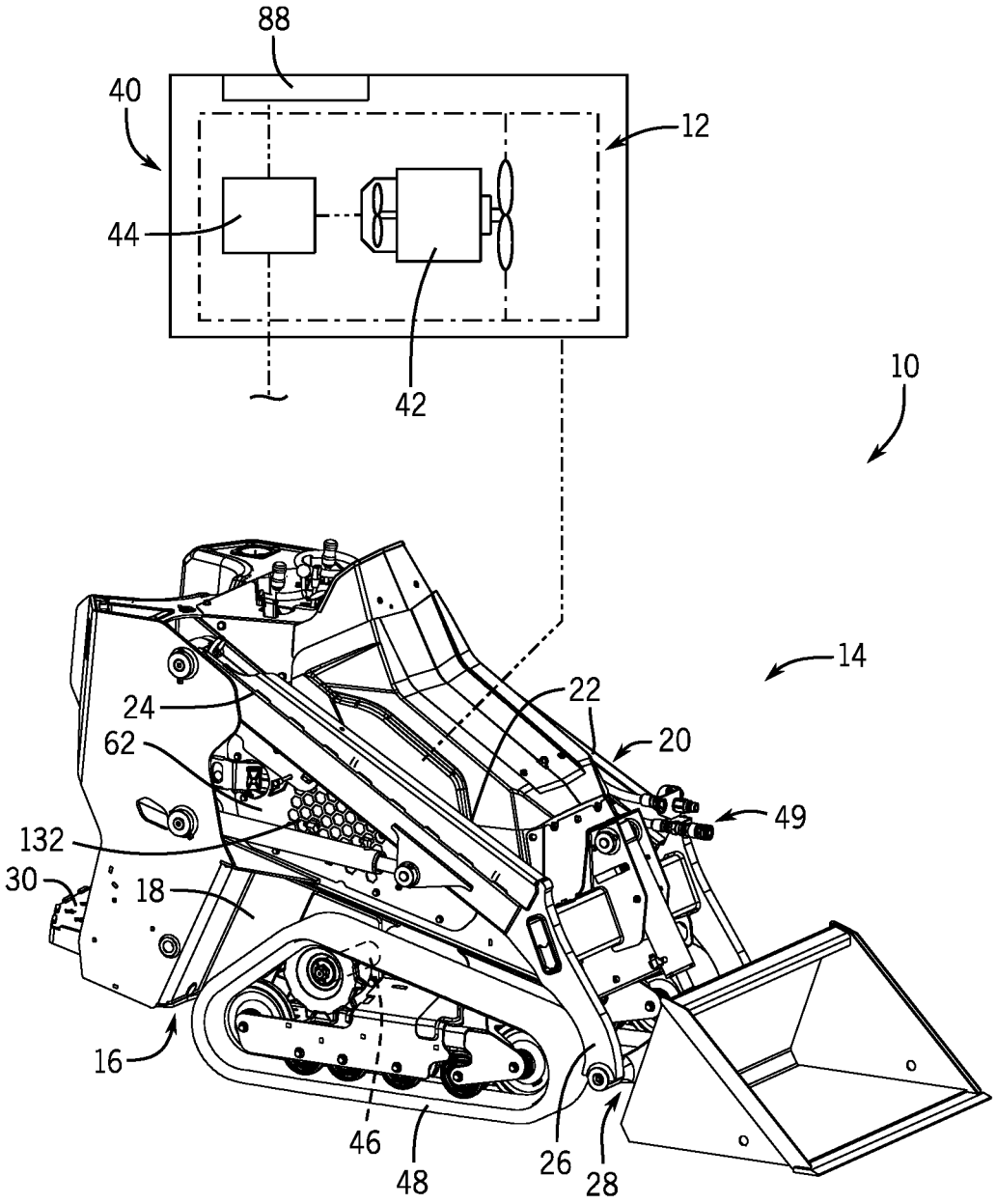
FIG. 1 is a pictorial view of a compact loader implementing a passive cooling system according to aspects of the invention.

Referring now to FIG. 1, in accordance with an aspect of the invention, a compact utility machine is shown in the form of compact loader 10 that is equipped with a passive cooling system 12. The compact loader 10 may be one of the general type that is commercially available from Wacker Neuson America Corporation of Menomonee Falls, Wisconsin.

Still referring to FIG. 1, compact loader 10 includes a chassis 16 with a frame 18 that provides an undercarriage and a boom support to a boom 20 with lift arms 22. Lift arms 22 are attached at their upper ends 24 to the frame 18 toward a back end of the compact loader 10. At the tool end or front end of compact loader 10, lower ends 26 of the lift arms 22 are connected to a tool carrier 28. Tool carrier 28 typically includes a quick-release connector for attaching different tools or accessories to the lift arms 20. Operator platform 30, shown configured to accommodate a standing operator, is connected to the frame 18 at an operator end or the back end of compact loader 10.

Still referring to FIG. 1, drive system 40 includes an engine 42, represented here as an air-cooled engine that powers hydraulic system 44. Hydraulic system 44 provides hydraulic power for moving the compact loader 10 by selectively driving a pair of drive motors 46 (only one shown) to independently control rotation of tracks 48 (only one shown). Hydraulic system 44 is also used for actuating the boom 20 and its carried tool or accessory through lift/lower and curl/uncurl functions. Hydraulic system 44 further provides auxiliary hydraulic flow to power hydraulically powered accessories through hydraulic remotes 49.

Figure 2:
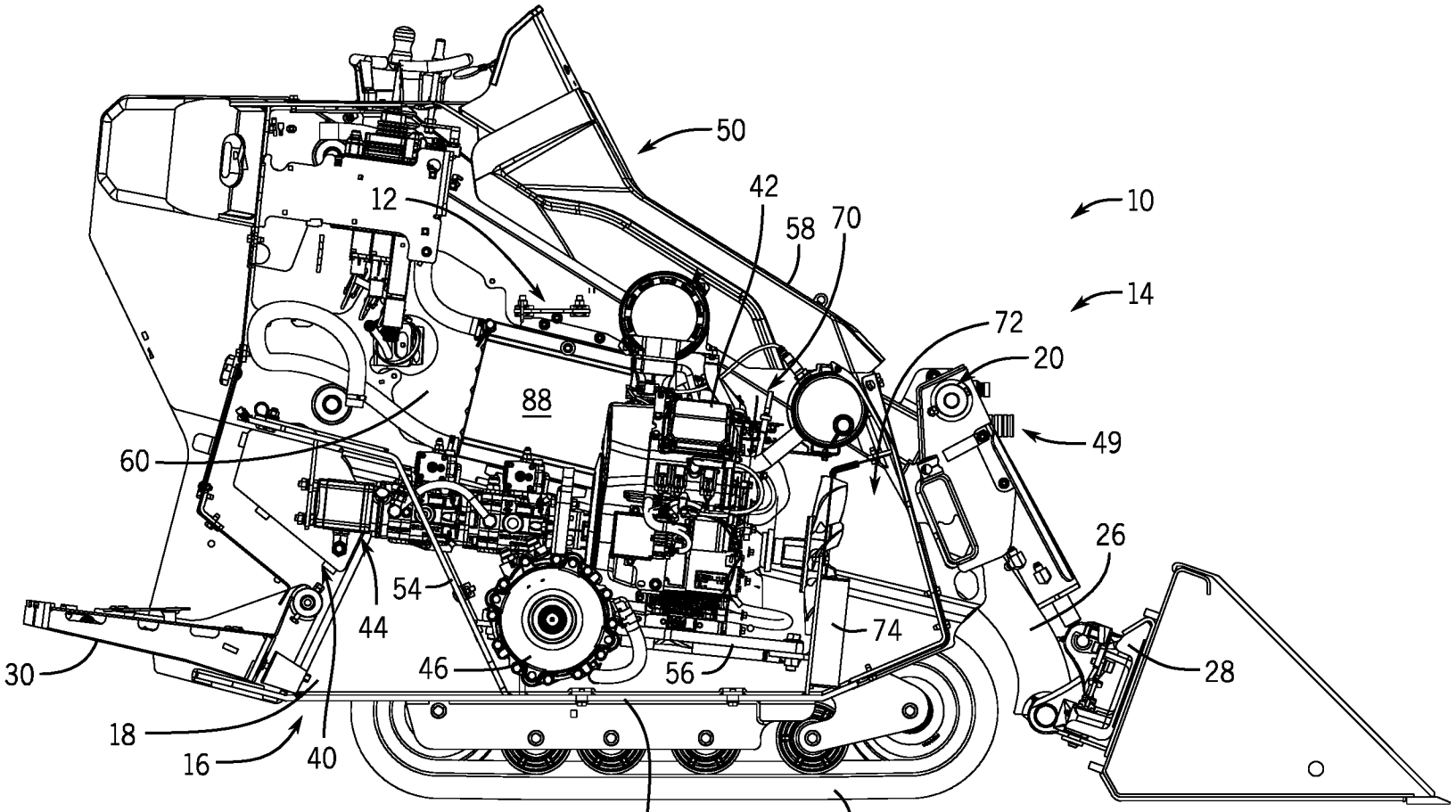
FIG. 2 is a cross-sectional side elevation of the compact loader shown in FIG. 1.

Referring now to FIG. 2, passive cooling system 12 typically includes at least portions of various bodywork-type components of compact loader 10. The bodywork may provide an engine compartment 50 that is implemented as an enclosure with interconnected panels. These panels may include a belly pan or bottom wall 52 that is defined by a portion of or otherwise supported by frame 18 and rear compartment baffle 54 that is connected to bottom wall 52 and that extends angularly up and rearwardly, supporting a portion of the hydraulic system 44 at its rearward end, toward the operator platform 30. Engine support platform 56 is supported by frame 18, to which engine 42 is mounted, and is vertically spaced above bottom wall 52. The panels also include a hood or top wall 58 that defines an upper boundary of the engine compartment 50 and side walls 60, 62 (only sidewall 60 shown in this view) that define side boundaries of the engine compartment 50. Engine compartment 50 includes a main compartment segment 70 and nose segment 72. A fan shroud 74 separates the main compartment segment 70 and nose segment 72.

Figure 3:
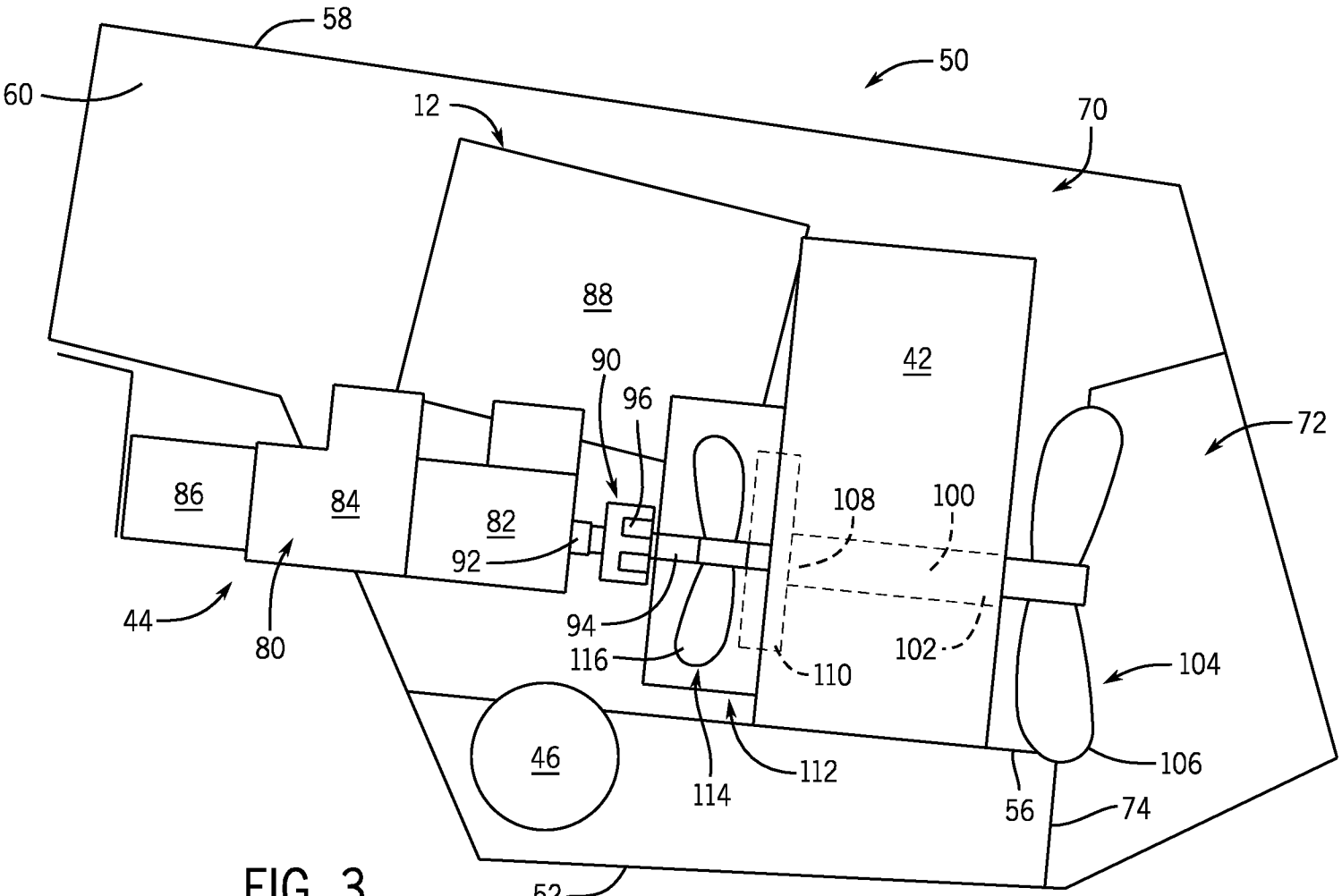
FIG. 3 is a schematic side elevation of an engine compartment that includes the passive cooling system according to aspects of the invention.

Referring now to FIG. 3, passive cooling system 12 is configured to evacuate air from the engine compartment 50 and to draw in ambient air. This establishes a cooling airflow through the engine compartment 50 from its back end toward its front end for cooling engine 42 and various components of hydraulic system 44. Hydraulic system 44 has at least one hydraulic pump, shown here as a pump stack 80 with multiple axially aligned and connected pumps 82, 84, 86. With respect to a back-to-front airflow through ending compartment 50, the pump stack 80 is mounted upstream relative to engine 42. By being upstream of the engine 42 relative to a flow direction of a cooling-airflow, the pump stack 80 is in an operational envelope that is substantially outside of a heat-influence zone of the engine 42, since heated air from the engine is substantially evacuated in a forward direction. Also upstream of engine 42 is the hydraulic system's hydraulic oil cooler 88. The oil cooler's 88 operational envelope is also substantially outside of the heat-influenced zone of the engine 42.

Still referring to FIG. 3, coupler 90 connects an input shaft 92 the pump stack 80 to an output shaft 94 of engine 42, spacing the pump stack from the engine 42. Typically, coupler 90 is a jaw-style coupler with rubber or other damping elements 96 between cooperating teeth of segments of coupler 90 that are respectively mounted to the pump stack input shaft 92 and engine output shaft 94. Engine output shaft 94 is axially aligned with or corresponds to the engine's crankshaft 100. Crankshaft 100 drives a PTO shaft or defines a PTO output at a first or forward end 102. An exhaust fan 104 with blades 106 is mounted to PTO shaft or forward crankshaft end 102, within an opening of fan shroud 74. At a second or rearward end 108 of crankshaft 100, the engine's flywheel 110 is mounted to the crankshaft 100. A blower housing 112 is mounted to the engine 42 and generally encloses an engine-cooling fan 114 with blades 116. Blower housing 112 radially shrouds the engine-cooling fan 114 and is configured to direct a corresponding airflow across and around engine 42. Typically, the exhaust fan 104 and engine-cooling fan 114 are coaxially aligned and rotate in unison with each other, driven at opposite ends of crankshaft 100. Engine-cooling fan 114 may be radially smaller than and have a lower flow rate than that of exhaust fan 104. It is understood that the exhaust fan 104 may provide a greater flow rate than the engine-cooling fan 114 and yet have the same or a smaller radius than the engine-cooling fan 114, based on factors such as blade pitch or surface area.

Figure 4:
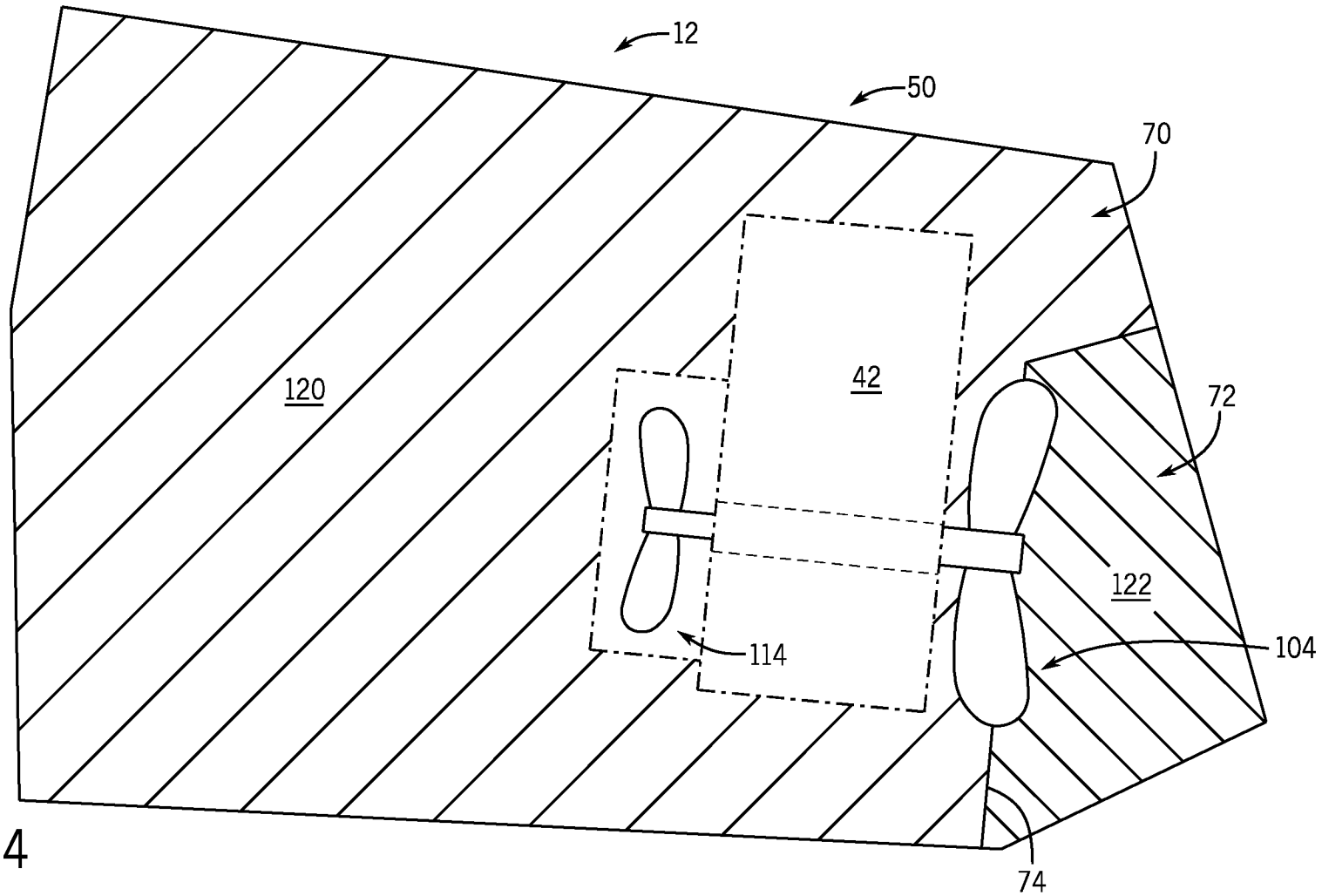
FIG. 4 is another schematic side elevation of the engine compartment.

Referring now to FIG. 4, when engine 42 is operating, both the exhaust fan 104 and engine-cooling fan 114 rotate, which evacuates air out of the front of the engine compartment 50. The exhaust and engine cooling fans 104, 114 push air out of engine compartment's 50 main compartment segment 70 into a nose segment 72, which is vented to the atmosphere. This establishes a pressure differential across the fan shroud 74, with a negative pressure zone 120 with a lower than ambient pressure defined in the main compartment segment 70, represented by horizontal dashed-lines, and a positive pressure zone 122 with a higher than ambient pressure defined in the nose segment 72, represented by horizontal solid-lines.

Figure 5:
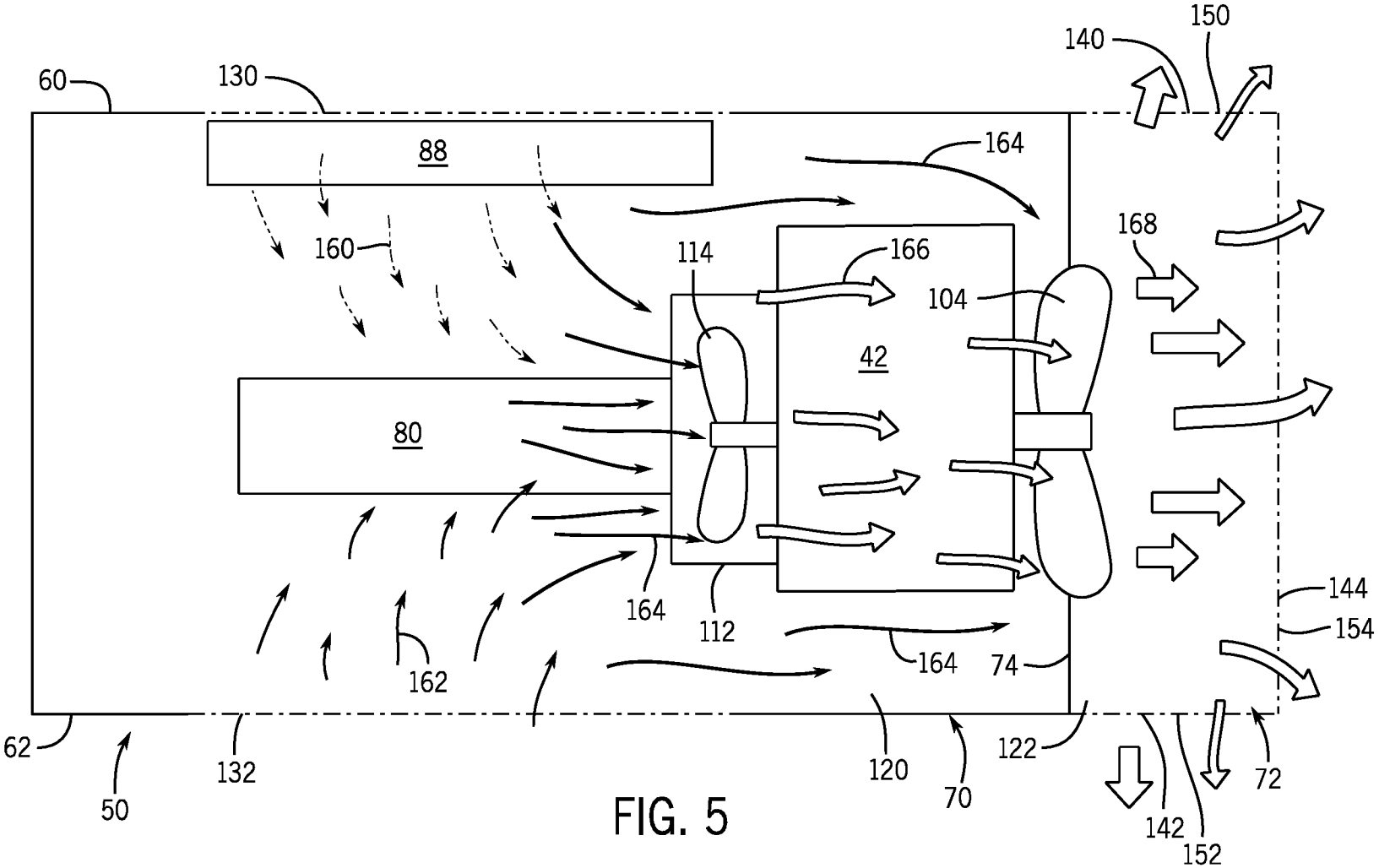
FIG. 5 is another schematic side elevation of the engine compartment, showing various airflow segments.

Referring now to FIG. 5, the pressure differential(s) between the negative pressure zone 120 and positive pressure zone 122 establish various airflows through the engine compartment 50 that allow the passive cooling system 12 to cool various components, such as those of hydraulic system 44. The airflows and airflow segments and flow directions and characteristics are established as functions of the configurations and locations of various inlets and outlets as well as a passive air flow driving force established by a pressure differential(s) provided between the engine compartment 50 and the ambient. Each of the engine compartment's side walls 60, 62 is shown with a respective inlet 130, 132. Each of interconnected walls 140, 142, 144 of the engine enclosure's nose segment 72 is shown with respective outlets 150, 152, 154. Typically, the outlets 150, 152, 154 of the nose segment's walls 140, 142, 144 occupy the major wall surface areas of the nose segment's walls 140, 142, 144. The nose segment's walls 140, 142, 144 have a substantially open mesh or screen configuration with typically at least 50% openness of surface area, and more typically at least 80% openness, to permit free airflow therethrough.

Still referring to FIG. 5, the exhaust and engine-cooling fans 104, 114 rotate to force air out of the main compartment segment 70 and into the nose segment 72, pressurizing the nose segment 72 and drawing a vacuum within the main compartment segment 70. Correspondingly, the negative pressure zone 120 and positive pressure zone 122 are established. The vacuum in the negative pressure zone 120 draws ambient air as cooling air into the main compartment segment 70. A first inlet airflow segment or volume 160, represented by the short dashed arrows, is drawn through inlet 130. The first inlet airflow segment 160 is directed through the oil cooler 88, which is typically mounted to side wall 60 at a position that overlies inlet 130. This provides passively cooling to oil cooler 88, without requiring the mounting of an ancillary fan, adjacent to or otherwise directly forcing an airflow through the oil cooler 88. At the other side of engine compartment 50, a second inlet airflow segment 162 or volume, represented by the short solid arrows, is drawn through inlet 132 into the general open space in the main compartment segment 70. The first and second inlet airflow segments 160, 162 initially flow toward each other, perpendicularly with respect to a centerline of the engine compartment 50. The first and second inlet airflow segments 160, 162 merge with each other and change direction to flow parallel to the centerline of the engine compartment 50, defining a merged airflow segment 164 or volume that is represented by the longer bold and solid arrows. The merged airflow segment 164 flows toward the exhaust and engine-cooling fans 104, 114. At least some of the merged airflow segment 164 is drawn into an annular inlet of blower housing 112. In the blower housing 112, engine-cooling fan 114 pushes a volume of air as an engine-cooling airflow segment or volume 166, represented as thin open arrows, across the engine 42 and toward exhaust fan 104. The exhaust fan 104 pushes a volume of air through the opening of fan shroud 74, into the nose segment 72 as an exhaust airflow segment or volume 168, represented by thick open arrows. In the nose segment 72, the exhaust airflow segment 168 diffuses out of the outlets 150, 152, 154 as driven out by the pressurization of positive pressure zone 122.

Accordingly, the passive cooling system 12 may implement forward-mounted air-moving components driven by and/or incorporated into an air-cooled engine 42 to direct the heated air out the front of the compact loader 10. This passively provides substantial cooling of the hydraulic system 44 while directing the heated air away from the operator. Since the airflow(s) of passive cooling system 12 directs the exhausted air away the operator, not only is the operator exposed to less component operational heat during use, but the operator is also exposed to less dust or other air-entrained particles that are common during machine operation.

It should be apparent from the foregoing that the concepts described herein are applicable to other compact utility machines, including compact telehandlers and compact trenchers, as well as to compact utility machines configured to accommodate riding operators or standing operators.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

As indicated above, many changes and modifications may be made to the present invention without departing from the spirit thereof. The scope of some of these changes is discussed above. The scope of others is apparent from the appended claims.

What is claimed is:

1. A compact utility machine, comprising:

a chassis that includes a frame;

an engine compartment that defines an enclosure supported by the frame;

an engine mounted within the engine compartment; and a passive cooling system, including:

a fan driven by the engine to create an airflow through the engine compartment;

a negative pressure zone which is defined within the engine compartment longitudinally upstream of the engine, and which is configured to establish a lower-than-ambient pressure when the fan is driven by the engine; and a positive pressure zone which is defined within the engine compartment longitudinally downstream of the engine and which is configured to establish a higher-than-ambient pressure when the fan is driven by the engine and to drive an airflow out of the engine compartment.

2. The compact utility machine of claim 1, wherein, when the fan is driven by the engine, the fan rotates within a fan shroud, and the fan shroud defines a boundary between the negative pressure zone and the positive pressure zone within the engine compartment.

3. The compact utility machine of claim 1, wherein:

the fan defines an exhaust fan that is configured to push air:

away from the engine;

away from the negative pressure zone; and toward the positive pressure zone.

4. The compact utility machine of claim 3, wherein:

the exhaust fan defines a first fan;

the engine is an air-cooled engine that includes a crankshaft and a blower housing; and a second fan that defines an engine-cooling fan is mounted to a first end of the crankshaft, configured to rotate within the blower housing, and is configured to establish an engine-cooling airflow that flows across the engine.

5. The compact utility machine of claim 4, wherein:

the exhaust fan is mounted to a second end of the crankshaft; and a portion of a volume of air that the exhaust fan pushes toward the positive pressure zone is the engine-cooling airflow and is received from the blower housing.

6. The compact utility machine of claim 5, wherein:

the exhaust fan has a first diameter and establishes an engine compartment exhaust airflow with a first flow rate;

the engine-cooling fan has a second diameter that is smaller than the first diameter and the engine-cooling airflow has a second flow rate that is less than the first flow rate of the engine compartment exhaust airflow.

7. The compact utility machine of claim 3, further comprising a hydraulic system that is powered by the engine, wherein:

the hydraulic system includes an oil cooler that is configured to cool a volume of hydraulic oil of the hydraulic system;

the engine compartment includes at least one air inlet; and the oil cooler is mounted in the negative pressure zone of the engine compartment in alignment with the at least one air inlet of the engine compartment to receive an airflow from the at least one air inlet.

8. The compact utility machine of claim 7, wherein:

the enclosure of the engine compartment defines first and second side walls that respectively provide first and second side boundaries of the low pressure zone;

the at least one air inlet includes a first air inlet that extends through the first engine compartment side wall, a second air inlet that extends through the second engine compartment side wall;

a first volume of ambient air is drawn through the first air inlet as a first inlet airflow segment and directed through the oil cooler while flowing into the negative pressure zone at a first end of the engine compartment;

a second volume of ambient air is drawn through the second air inlet as a second inlet airflow segment and flows into the negative pressure zone at the first end of the engine compartment.

9. The compact utility machine of claim 8, wherein:

the first and second inlet airflow segments are drawn through the first and second air inlets enter the engine compartment with generally opposite flow directions;

the first and second inlet airflow segments merge to define a merged airflow segment that flows toward the exhaust fan and generally perpendicularly with respect to the first and second inlet airflow segments and generally perpendicularly with respect to the first and second compartment side walls.

10. The compact utility machine of claim 9, wherein:

the engine includes a crankshaft with a first end and a second end;

the exhaust fan is driven by the first end of the crankshaft;

a second fan is driven by the second end of the crankshaft; and the first and second fans are configured to rotate about a common axis of rotation.

11. The compact utility machine of claim 10, wherein:

the engine is an air-cooled engine;

a blower housing is mounted to an engine block of the air-cooled engine;

the second fan defines an engine-cooling fan mounted within the blower housing and configured to establish an engine-cooling airflow.

12. The compact utility machine of claim 11, further comprising:

a hydraulic system with a hydraulic pump driven by the second end of the crankshaft;

a coupler that connects the hydraulic pump to the second end of the crankshaft and spaces the hydraulic pump from the blower housing.

13. The compact utility machine of claim 1, wherein the machine comprises a compact loader, and the positive pressure zone is located toward a front end of the compact loader; and further comprising an operator platform that is supported on the chassis, that is configured to support a standing operator, and that is located toward a back end of the compact loader.

14. The compact utility machine of claim 13, further comprising:

a nose segment is arranged toward a front end of the engine compartment; and wherein the positive pressure zone is defined in the nose segment; and within the engine compartment, the exhaust fan and the engine-cooling fan pull a volume of heated air through the negative pressure zone away from the operator platform and toward the nose segment.

15. The compact utility machine of claim 14, wherein the compact utility machine is a utility loader that includes a boom and a tool carrier connected to the boom.

16. A compact loader, comprising:

a chassis that includes a frame;

an operator platform that is supported on the chassis, that that is configured to support a standing operator, and that is located toward a back end of the compact loader;

an engine compartment that defines an enclosure supported by the frame;

an air-cooled engine mounted within the engine compartment;

a hydraulic system having an oil cooler that is configured to cool hydraulic oil of the hydraulic system;

a passive cooling system, including:

an exhaust fan that is driven by the air-cooled engine to drive an airflow out of the engine compartment longitudinally downstream of the engine;

an engine-cooling fan that is driven by the air cooled engine and that delivers engine cooling air toward across the engine and toward the exhaust fan;

an air inlet that extends through the engine compartment; and wherein:

the oil cooler is mounted inside of the engine compartment, that is aligned with the air inlet to receive an airflow from the air inlet, and that is located upstream of each of the exhaust fan and the engine-cooling fan.

17. The compact loader of claim 16, further comprising a hydraulic pump that is driven by engine, a rotational axis of the engine-cooling fan, and a rotational axis of the exhaust fan are in axial alignment with each other.

18. A method of operating a compact utility machine that defines an operator end and an opposite tool end, the compact utility machine having passively cooling components within an engine compartment of the compact utility machine, the method comprising:

running an air-cooled engine that is housed in the engine compartment;

rotating an exhaust fan with the engine in the engine compartment;

establishing a negative pressure zone in the engine compartment toward the operator end of the compact utility machine by directing an airflow through the engine compartment by pushing a volume of air out of the engine compartment toward the tool end with the exhaust fan; and cooling a component that is mounted within the negative pressure zone of the engine compartment with the airflow that flows from the operator end of the compact utility machine to the tool end of the compact utility machine.

19. The method of claim 18, wherein an air inlet is provided in a wall of the engine compartment and an oil cooler is mounted to the wall against the air inlet and the method further comprises:

cooling a volume of oil flowing through the oil cooler by drawing ambient air through the air inlet and the oil cooler by way of a pressure differential established between the negative pressure zone and the ambient.

20. The method of claim 19, wherein the air-cooled engine includes a crankshaft and an engine-cooling fan that is mounted in a blower housing of the engine; and the method further comprises:

rotating the engine-cooling fan in the blower housing with a first end of the engine crankshaft;

rotating the exhaust fan with a second end of the engine crankshaft; and delivering air out of the blower housing toward the exhaust fan.

* * * * *